US009664190B2

(12) United States Patent
Kim et al.

(10) Patent No.: US 9,664,190 B2
(45) Date of Patent: May 30, 2017

(54) COMPRESSOR

(71) Applicant: Samsung Electronics Co., Ltd., Suwon-si (KR)

(72) Inventors: Byung Gu Kim, Suwon-si (KR); Yang Sun Kim, Anyang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 281 days.

(21) Appl. No.: 14/535,653

(22) Filed: Nov. 7, 2014

(65) Prior Publication Data

US 2015/0167670 A1 Jun. 18, 2015

(30) Foreign Application Priority Data

Dec. 16, 2013 (KR) ..... 10-2013-0156412

(51) Int. Cl.

| | |
|---|---|
| ***F01C 1/063*** | (2006.01) |
| ***F03C 2/02*** | (2006.01) |
| ***F04C 2/063*** | (2006.01) |
| ***F04C 18/063*** | (2006.01) |
| ***F01C 21/04*** | (2006.01) |

(Continued)

(52) U.S. Cl.

CPC ..... *F04C 18/0215* (2013.01); *F04B 39/023* (2013.01); *F04B 39/0284* (2013.01); *F04B 39/04* (2013.01); *F04C 23/008* (2013.01); *F04C 29/026* (2013.01); *F04C 29/028* (2013.01);

(Continued)

(58) Field of Classification Search

CPC . F16D 1/033; F16D 1/04; F16D 1/076; F16D 1/08; F16D 3/50; F16D 3/78; Y10T 403/7026; Y10T 403/7033; Y10T 403/7035

USPC ..... 418/88, 89, 90, 55.1–55.6, 57, 270, 418/DIG. 1, 97; 248/637, 671, 672, 680, (Continued)

(56) References Cited

U.S. PATENT DOCUMENTS 7,748,969 B2 * 7/2010 Um ..... F04C 18/0215 184/6.16
2009/0266302 A1 * 10/2009 Duval ..... A01K 7/005 119/72

FOREIGN PATENT DOCUMENTS

KR 20020008657 A * 1/2002 ..... B60K 15/03

OTHER PUBLICATIONS

English Translation Korean Patent Publication 10-2002-008657 Jan. 2002, by K-Pion.*

* cited by examiner

*Primary Examiner* — Deming Wan
(74) *Attorney, Agent, or Firm* — Staas & Halsey LLP

(57) ABSTRACT

A compressor provided with an oil stabilizing member capable of preventing oil stored in an oil storage space from being scattered is provided. A compressor may include a closed container provided with an inlet port and an outlet port, a compression unit configured to compress refrigerant introduced into an inside the closed container through the inlet port, a driving unit configured to provide a driving force to drive the compression unit, a rotating shaft configured to deliver the driving force to the compression unit, an oil storage space formed at a lower portion of an inside the closed container and configured to store a predetermined oil to come into contact with one end portion of the rotating shaft, and an oil stabilizing member installed so as to move along a surface of oil formed at the oil storage space, thereby preventing the oil from being scattered and thus released through the outlet port, wherein the oil stabilizing member (Continued)

floating on the surface of the oil prevents oil from being scattered upward according to operation of the compressor.

13 Claims, 7 Drawing Sheets

(51) Int. Cl.

| | |
|---|---|
| ***F01M 1/06*** | (2006.01) |
| ***F01M 1/20*** | (2006.01) |
| ***F16N 7/36*** | (2006.01) |
| ***F04C 18/02*** | (2006.01) |
| ***F04C 23/00*** | (2006.01) |
| ***F04B 39/02*** | (2006.01) |
| ***F04C 29/02*** | (2006.01) |
| ***F04B 39/04*** | (2006.01) |

(52) U.S. Cl.
CPC .... *F04C 18/0207* (2013.01); *F04C 2240/809* (2013.01)

(58) Field of Classification Search
USPC ..... 248/218.4; 464/98; 403/359.1, 359.5, 403/59.6; 184/6.21–6.23, 6.16, 6.18
See application file for complete search history.

COMPRESSOR

CROSS-REFERENCE TO RELATED APPLICATIONS

This application claims the priority benefit of the Korean Patent Application No. 10-2013-0156412, filed on Dec. 16, 2013, in the Korean Intellectual Property Office, the disclosure of which is incorporated herein by reference.

BACKGROUND

1. Field

Embodiments relate to a compressor, and more particularly, to a compressor having an oil stabilizing member configured to prevent oil stored in an oil storage space from being scattered.

2. Description of the Related Art

A scroll compressor is a compressor configured to compress a refrigerant gas by changing the volume of a compression chamber by use of a pair of scrolls. The scroll compressor is provided with higher efficiency, lower vibration, and lower noise when compared with a reciprocating type compressor or a rotary compressor, and may be provided in lightweight and miniaturized state, and thus is being widely used in a refrigerating cycle apparatus.

The scroll compressor is provided with fixed scroll a compression chamber formed by a fixed scroll accommodated at an inside a closed container and an orbiting scroll configured to turn relative to the fixed scroll. The compression chamber is gradually narrowed toward an inner circumferential side from an outer circumferential side by the revolution of the orbiting scroll. Refrigerant is suctioned from the outer circumferential side of the compression chamber to be compressed, and is discharged from a central portion of the compression chamber to an inside the closed container.

A bearing surface between the fixed scroll and the orbiting scroll as such may be damaged from friction, and thus is lubricated by use of oil. A predetermined amount of oil is stored in the oil storage space positioned at a lower portion of inside the sealed container, and is supplied through an oil flow path of a rotating shaft.

However, in a case when the rotating speed of the compressor is increased, the surface of the oil stored in the oil storage space is not stabilized, and may be scattered upward. The oil scattered upward may be released from the compressor together with the refrigerant, and may circulate through a refrigerant cycle. The oil as such may lower heat exchanging efficiency while accumulated at a heat exchanger, or compression efficiency may be reduced by the oil that is introduced again into the compressor.

SUMMARY

In an aspect of one or more embodiments, there is provided a compressor which is provided with an oil stabilizing member capable of stabilizing the surface of the oil stored in an oil storage space due to the operation of the compressor.

In an aspect of one or more embodiments, there is provided a compressor which is provided with an oil stabilizing member capable of preventing oil from being scattered upward by moving up and down along the surface of the flowing oil.

In an aspect of one or more embodiments, there is provided a compressor which includes a closed container, a compression unit, a driving unit, a rotating shaft, an oil storage space and an oil stabilizing member. The closed container may be provided with an inlet port and an outlet port. The compression unit may be configured to compress refrigerant introduced into an inside the closed container through the inlet port. The driving unit may be configured to provide a driving force to drive the compression unit. The rotating shaft may be configured to deliver the driving force to the compression unit. The oil storage space may be formed at a lower portion of an inside the closed container to store a predetermined oil while in contact with one end portion of the rotating shaft. The oil stabilizing member may be installed so as to move along a surface of oil formed at the oil storage space, thereby preventing the oil from being scattered and thus released through the outlet port.

The oil stabilizing member may include a coupler allowing the rotating shaft to be inserted thereinto after passing therethrough. The oil stabilizing member may be moved along the rotating shaft in response to flow of the oil.

A guide configured to guide the movement of the oil stabilizing member may be positioned between the coupler and the rotating shaft.

The compressor may further include a lower flange coupled to a lower portion of an inner side of the closed container to rotatably support a lower portion of the rotating shaft with respect to the closed container, wherein the guide may be inserted around the rotating shaft and fixedly coupled to the lower flange.

The guide may include at least one moving groove. The oil stabilizing member may include at least one moving protrusion protruding from the coupler toward the guide, so that the at least one moving protrusion is inserted into the at least one moving groove, thereby coupling the oil stabilizing member to the guide.

The at least one moving groove may be formed in a longitudinal direction, and the oil stabilizing member may be moved in a longitudinal direction along the at least one moving groove.

The guide may include a fixing step positioned at an upper portion of the at least one moving groove to fix an upward movement of the at least one moving protrusion moving along the at least one moving groove.

The guide may include at least one screw coupling part to be coupled to the lower flange, and the at least one screw coupling part circumferentially may protrude at a lower portion of the guide.

The oil stabilizing member may include at least one penetrating groove that is formed in a recessed manner at the coupler while having a shape corresponding to the at least one screw coupling part, so that the oil stabilizing member is coupled to the guide after passing through the at least one screw coupling part.

The oil stabilizing member may be provided in a form of a planar panel to cover the surface of the oil formed at the oil storage space by gravity.

The oil stabilizing member may be spaced apart by a predetermined interval from an inner surface of the closed container such that the oil dropping downward after being delivered to the driving unit and the compression unit through the rotating shaft is introduced again into the oil storage space.

A lower surface of the oil stabilizing member which makes contact with the surface of the oil may include at least one concavo-convex structure.

The at least one concavo-convex structure may include an inside space allowing gas to be injected thereinto so that the oil stabilizing member is provided with a lift to move along the surface of the oil according to the flow of the oil.

The oil stabilizing member may be formed of material having a specific gravity smaller than a specific gravity of the oil, so that the oil stabilizing member flows on the surface of the oil while moving along the flow of the oil.

In an aspect of one or more embodiments, there is provided a compressor which includes a fixed scroll, an orbiting scroll, a rotating shaft, upper and lower flanges and an oil stabilizing member. The fixed scroll may be fixed at an inside a closed container. The orbiting scroll may be configured to compress refrigerant while revolving relative to the fixed scroll. The rotating shaft may be configured to deliver a rotating force to the orbiting scroll. The upper and lower flanges may be fixed to upper and lower end portions of an inner side of the closed container to rotatably support the rotating shaft. The oil stabilizing member may be movably installed at an upper portion of the lower flange to prevent oil stored at a lower portion of an inside the closed container from being scattered.

The oil stabilizing member may move up and down along the rotating shaft according to flow of the oil.

The compressor may further include a guide inserted around the rotating shaft to be coupled to the lower flange. The guide may be positioned between the oil stabilizing member and the rotating shaft.

The guide may be coupled to the lower flange by use of at least one screw, and may be provided at a lower portion thereof with at least one screw coupling part to which the at least one screw is coupled.

The guide may include at least one groove vertically extending, and the oil stabilizing member may include at least one protrusion that is inserted into the at least one groove to move vertically along the at least one groove.

The guide may include a fixing step positioned at an upper portion of the at least one groove to fix an upward movement of the at least one protrusion to prevent the oil stabilizing member from being separated from the guide.

The oil stabilizing member may include at least one penetrating groove that corresponds to the at least one screw coupling part, so that the at least one protrusion is insertedly coupled to the at least one groove at a lower portion of the guide.

In accordance with another aspect of the present disclosure, a compressor includes a closed container, an oil storage space and an oil stabilizing member. The oil storage space may be formed at a lower portion of an inside the closed container. The oil stabilizing member may be configured to float while covering an oil surface formed by oil stored in the oil storage space, to stabilize the oil surface.

The oil stabilizing member may be formed of material that is lighter than the oil to float on the oil surface.

A surface of the oil stabilizing member making contact with the oil surface may be formed in a convex shape to receive a lift such that the oil stabilizing member floats on the oil surface.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
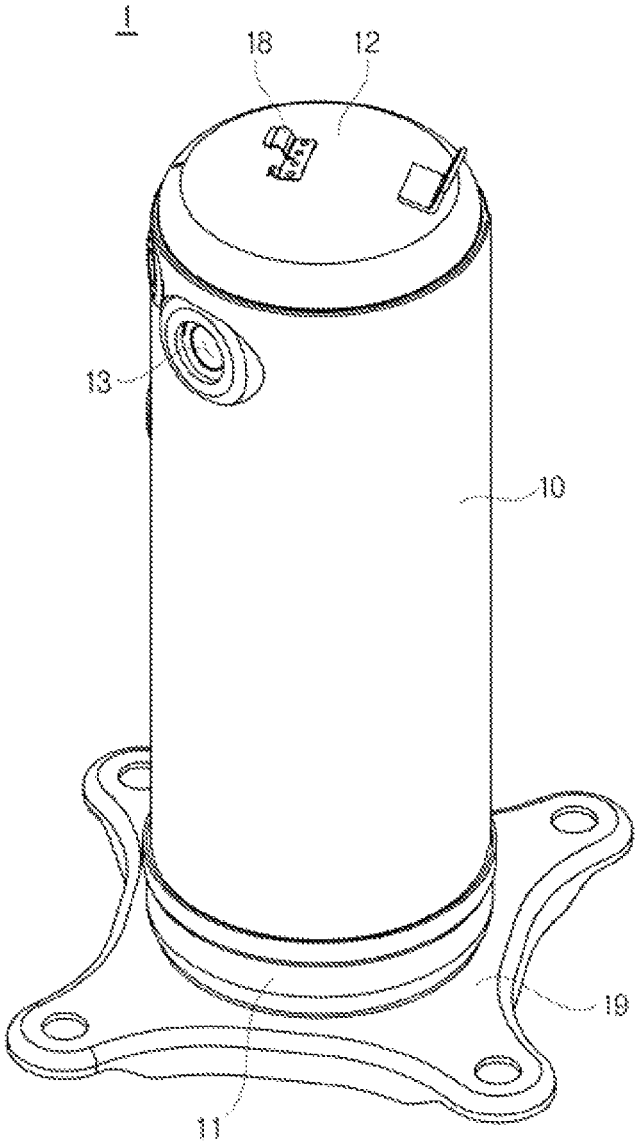
FIG. 1 is a drawing illustrating a compressor in accordance with an embodiment.

Reference will now be made in detail to embodiments, examples of which are illustrated in the accompanying drawings, wherein like reference numerals refer to like elements throughout.

Figure 2:
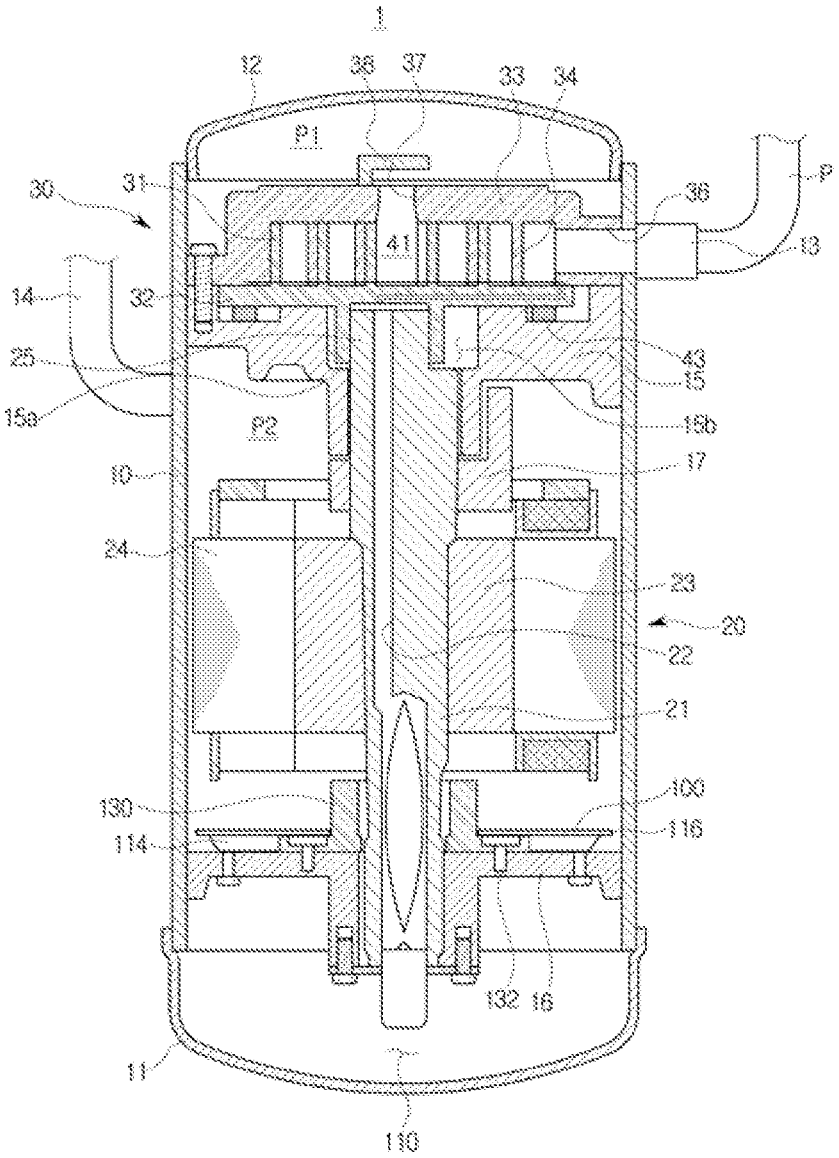
FIG. 2 is a cross sectional view illustrating the compressor in accordance with an embodiment.

FIG. 1 is a drawing illustrating a compressor 1 in accordance with an embodiment, and FIG. 2 is a cross sectional view illustrating the compressor 1 in accordance with an embodiment.

The compressor 1 includes a closed container 10 having an inside space therein, and a driving unit 20 and a compression unit 30 that are positioned at an inside the closed container 10. At an outer surface of the compressor 1, a fixing member 18 may be provided so that the compressor 1 is fixedly installed at an outdoor unit of an air conditioner. In addition, a bottom plate 19 may be provided so that the compressor 1 is stably settled and fixed to a floor surface.

The closed container 10 is provided at one side thereof with an inlet port 13 allowing refrigerant to be introduced therethrough, and at the other side of the closed container 10 with an outlet port 14 is provided so that the refrigerant introduced through the inlet port 13 and compressed to be discharged therethrough. At upper and lower portions of the closed container 10, an upper cap 12 and a lower cap 11 configured to seal an inside the closed container 10 may be mounted.

The driving unit 20 includes a stator 24 press-fitted at an inside of a lower side of the closed container 10, and a rotator 23 rotatably installed at a central portion of the stator 24. At the upper and lower portions of the rotator 23, a balance weight 17 is installed so that rotational imbalance may be adjusted at the time of when the rotator 23 is rotated.

At the upper and lower portions of an inner side of the closed container 10, an upper flange 15 and a lower flange 16 are fixed, respectively. The driving unit 20 may be positioned in between the upper flange 15 and the lower flange 16. In between the upper flange 15 and the lower flange 16, a rotating shaft 21 is mounted to deliver the rotational force generated from the driving unit 20 to an orbiting scroll 32 of the compression unit 30. At an upper end of the rotating shaft 21, an eccentric part 25 eccentrically provided with respect to a central portion of the rotating shaft 21 is formed.

At a central portion of the upper flange 15, a penetrating hole 15*a* allowing the rotating shaft 21 to be penetratively installed thereto is formed. An oil storage part 15*b* to store oil that is suctioned through the rotating shaft 21 may be formed around the penetrating hole 15*a*. An oil line 22 is penetratively formed in an axis direction of the rotating shaft 21, and at a lower end portion of the oil line 22, an oil pump (not shown) is installed.

The compression unit 30 includes a fixed scroll 33 and the orbiting scroll 32 configured to perform a rotation relative to the fixed scroll 33. The orbiting scroll 32 is driven by the rotating shaft 21 inserted thereinto, and an orbiting scroll wrap 31 having the shape of a spiral is formed at an upper surface of the orbiting scroll 32. The fixed scroll 33 is provided with a fixed scroll wrap 34 formed at a lower portion thereof, so that the orbiting scroll wrap 31 of the orbiting scroll 32 is engaged with the orbiting scroll wrap 31.

The orbiting scroll 32 is provided so as to turn at an upper surface of the upper flange 15, and the fixed scroll 33 is fixedly installed at the upper surface of the upper flange 15. The orbiting scroll 32 and the fixed scroll 33 form a compression chamber 41 as the orbiting scroll wrap 32 and the fixed scroll wrap 34 are engaged with one another. In between the orbiting scroll 32 and the upper flange 15, an Oldham's Ring 43 is configured to revolve the orbiting scroll 32 while preventing the orbiting scroll 32 from rotating.

The inside the closed container 10 is divided into an upper side part P1 and a lower side part P2 by the upper flange 15 and the fixed scroll 33, and the upper side part P1 and the lower side part P2 are provided in a state of high pressure. The fixed scroll 33 is at one side thereof with a suction port 36 communicating with a gas suction pipe P connected to the inlet port 13, and at a central portion of an upper surface thereof with a discharge port 37 to discharge the refrigerant compressed in the compression chamber 41 to the upper side part P1 of the closed container 10. At the discharge port 37, a valve unit 38 configured to open/close the discharge port 37 is provided to prevent the refrigerant gas from flowing backward.

The compressor 1 composed as the above is provided with the rotating shaft 21 being rotated along with the rotator 23 upon application of power, and the orbiting scroll 32 coupled to an upper end portion of the rotating shaft 21 revolves. The orbiting scroll 32 revolves while having the eccentric distance, that is, the distance from the central portion of the rotating shaft 21 to a central portion of the eccentric part 24, as a radius of turn. At this time, the orbiting scroll 32 is prevented from rotated by the Oldham's Ring 43.

As the orbiting scroll 32 revolves, the fixed scroll 33 revolves due to the fixed scroll wrap 34 engaged with the orbiting scroll wrap 31 of the orbiting scroll 32, and the compression chamber 41 is formed between the orbiting scroll wrap 31 and the fixed scroll wrap 34. A volume of the compression chamber 41 is reduced as the orbiting scroll 32 is moving toward a central portion by a continuous revolution, so that the suctioned refrigerant is compressed.

At this time, by the oil pump (not shown) installed at a lower end of the rotating shaft 21, the oil provided at the lower end portion of the closed container 10 is pumped, and the oil is moved toward an upper end through the oil line 22 of the rotating shaft 21. Some portion of the oil being moved toward the upper end of the rotating shaft 21 is supplied toward a side of the penetrating hole 15*a* of the upper flange 15, and some other portion of the oil is stored in the oil storage part 15*b* of the upper flange 15 while scattered at the upper end of the rotating shaft 21.

As for the fixed scroll 33 and the orbiting scroll 32 to smoothly revolve while engaged with one another, oil is needed to be smoothly supplied to a bearing surface between the fixed scroll 33 and the orbiting scroll 32. At a lower portion of an inside of the closed container 10 of the compressor 1, an oil storage space 110 may be provided for lubrication purpose.

As for the oil stored in the oil storage space 110 to be moved upward through the oil line 22 formed in an axis direction of the rotating shaft 21, a lower end of the rotating shaft 21 is extended to the oil stored in the oil storage space 110. The oil moved from the oil storage space 110 to the upper portion through the oil line 22 is supplied to the bearing surface in between the fixed scroll 33 and the orbiting scroll 32, and loss resulted from friction may be prevented.

The oil storage space 110 is formed at a lower portion of an inside the closed container 10, and thus the oil stored at the oil storage space 110 may move as the compressor 1 is driven. As the rotating speed of the driving unit 20 is increased, the surface of the oil stored at the lower portion may be in an unstable status, and may rapidly flow. The oil in the unstable state as such may be scattered toward an upper portion, and may be discharged along with refrigerant from the compressor 1. The oil discharged from the compressor 1 may be collected to the compressor 1 after passing through a refrigerating cycle including a heat exchanging apparatus along with the refrigerant, but in this case, the heat efficiency and compression efficiency of the heat exchanging apparatus may be degraded. Thus, as to enhance the heat efficiency and compression efficiency of the heat exchanging apparatus, an oil stabilizing member configured to stabilize the oil stored at the oil storage space 110 will be described.

Figure 3:
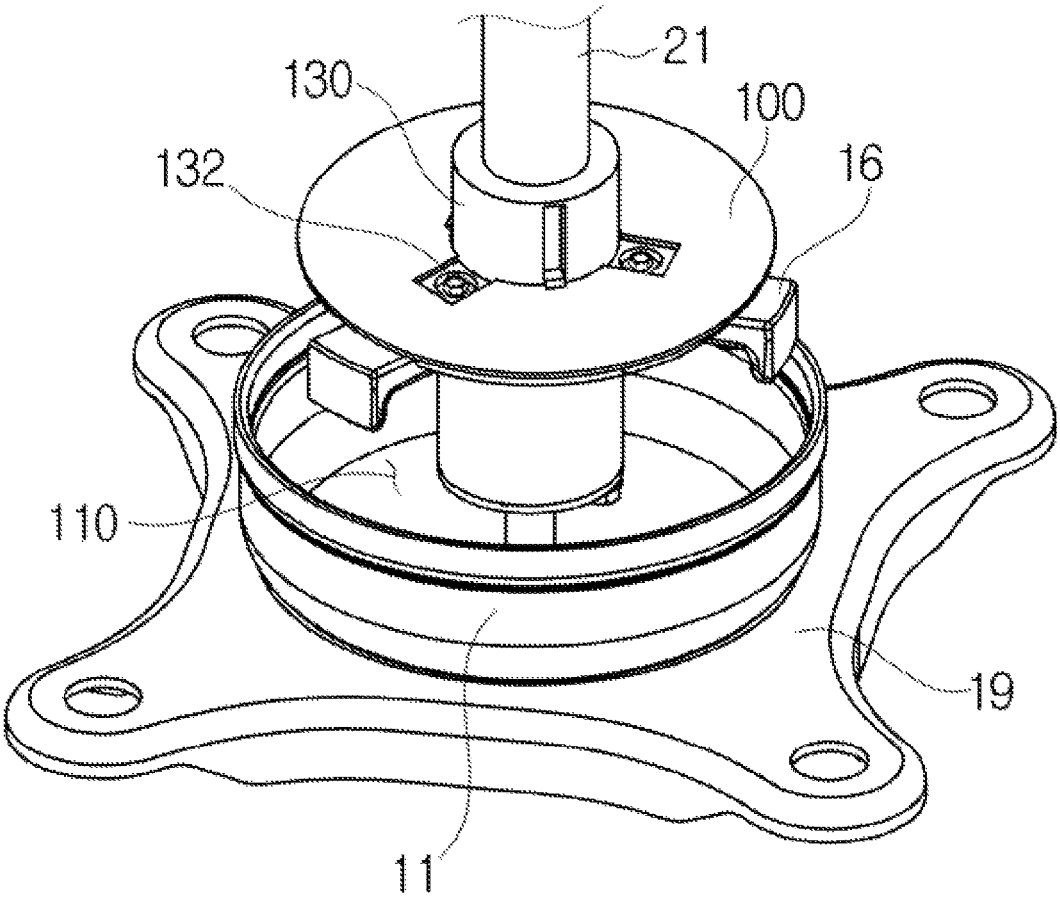
FIG. 3 is a drawing illustrating an oil stabilizing member of the compressor in accordance with an embodiment.
Figure 4:
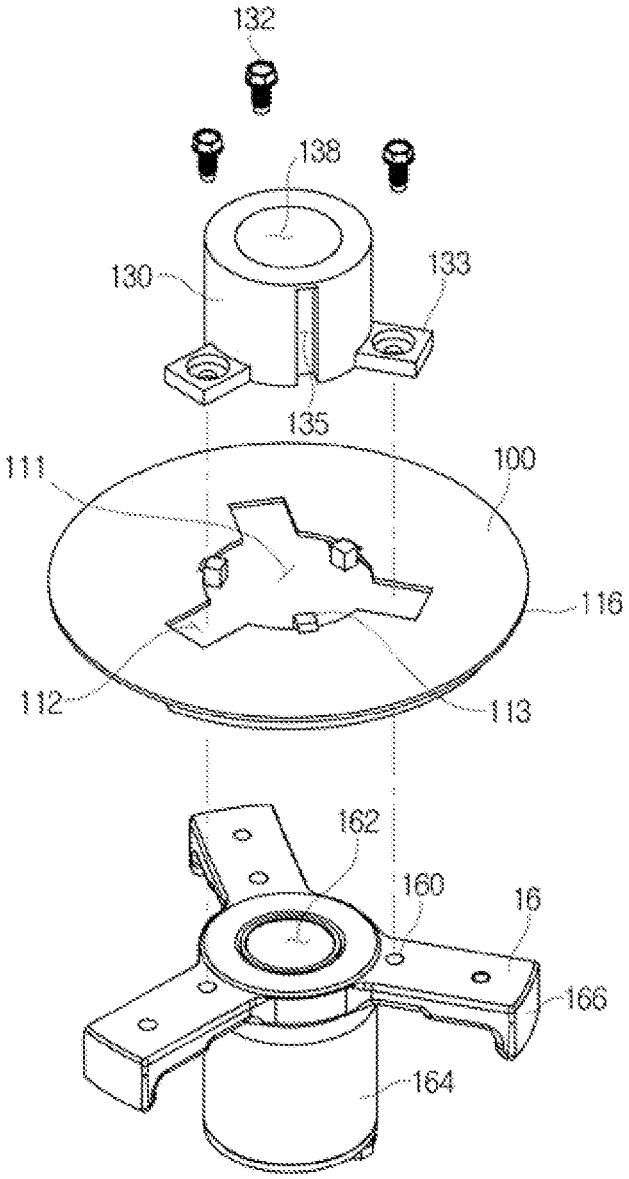
FIG. 4 is an exploded view illustrating an oil stabilizing member in accordance with an embodiment.

FIG. 3 is a drawing illustrating an oil stabilizing member of the compressor 1 in accordance with an embodiment, and FIG. 4 is an exploded view illustrating the oil stabilizing member of the compressor 1 in accordance with an embodiment.

As to supply the oil stored at the oil storage space 110 toward an upper portion, a lower portion of the rotating shaft 21 is provided in a way to make contact with the oil. The lower flange 16 configured to fix a lower portion of the rotating shaft 21 includes a body part 164 surrounding the rotating shaft 21 and a coupling part 166 coupled to an inner side surface of the closed container 10. As illustrated on FIG. 6, the coupling part 166 includes the total of three members being extended radially outside from a central part 162 coupled to the rotating shaft 21. One end of the coupling part 166 extended from the central part 162 may be fixed by use of a screw while making contact with an inner side surface of the closed container 10.

At an upper portion of the lower flange 16, an oil stabilizing member 100 configured to move along the flow of oil and a guide 130 configured to guide movement of the oil stabilizing member 100 may be positioned. The oil stabilizing member 100 may be movably installed along the surface of oil, and may prevent the oil from being scattered.

The oil stabilizing member 100 includes a coupler 111 allowing the rotating shaft 21 to be inserted thereinto while passing therethrough, so that the oil stabilizing member 100 may be inserted into the rotating shaft 21 so as to be moveable along the rotating shaft 21. The guide 130 may be positioned in between the rotating shaft 21 and the oil stabilizing member 100. The guide 130 is provided with the shape of a cylinder having a hollow hole and a predetermined thickness, so that the guide 130 may be positioned in between the coupler 111 and the rotating shaft 21.

The guide 130 is provided with a central part 138 allowing the rotating shaft 21 to be inserted, and is fixedly coupled to the lower flange 16. The guide 130 includes at least one screw coupling part 133 to be couple to the lower flange 16. The at least one screw coupling part 133 may circumferentially protrude at a lower portion of the guide 130. As for the guide 130 and the lower flange 16 to be coupled to one another by at least one screw 132, a screw hole 160 is formed at the lower flange 16 while corresponding to the screw coupling part 133.

As for the oil stabilizing member 100 to be moved along the guide 130 fixed at the lower flange 160, the guide 130 includes at least one moving groove 135. The oil stabilizing member 100 includes at least one moving protrusion 113 protruded toward the guide 130 from the coupler 111. The at least one moving protrusion 113 is inserted into the at least one moving groove 135, and the oil stabilizing member 100 and the guide 130 may be coupled to each another.

The moving groove 135 may be extendedly formed in a longitudinal direction at an outer surface of the guide 130. Thus, the oil stabilizing member 100 may be moved in a longitudinal direction along the moving groove 135 extended in the longitudinal direction.

As for the moving protrusion 113 that moves along the moving groove 135 to be fixed toward an upper side, the guide 130 may include a fixing step 137 positioned at an upper portion of the moving guide 135. The fixing step 137 may prevent the oil stabilizing member 100 from being separated upward from the guide 130. Thus, the oil stabilizing member 100 may be inserted around the guide 130 from a lower portion of the guide 130 in a direction in which the moving protrusion 113 is inserted into the moving groove 135. As to pass through the screw coupling part 133 circumferentially protruding, the oil stabilizing member 100 may include at least one penetrating groove 112 corresponding to the at least one screw coupling part 133. The penetrating groove 112 is formed in a recessed manner at the coupler 111 while having a shape corresponding to the at least one screw coupling part 133.

As illustrated on FIG. 4, the guide 130 has the screw coupling parts 133 protruded in three directions corresponding to the coupling parts 166 of the lower flange 16 formed in three directions, and the oil stabilizing member 100 has the penetrating grooves 112 corresponding to the screw coupling parts 133. In addition, the moving groove 135 is extendedly formed in a longitudinal direction between the screw coupling part 133, and the moving protrusion 113 is formed in between the penetrating grooves 112.

Figure 5:
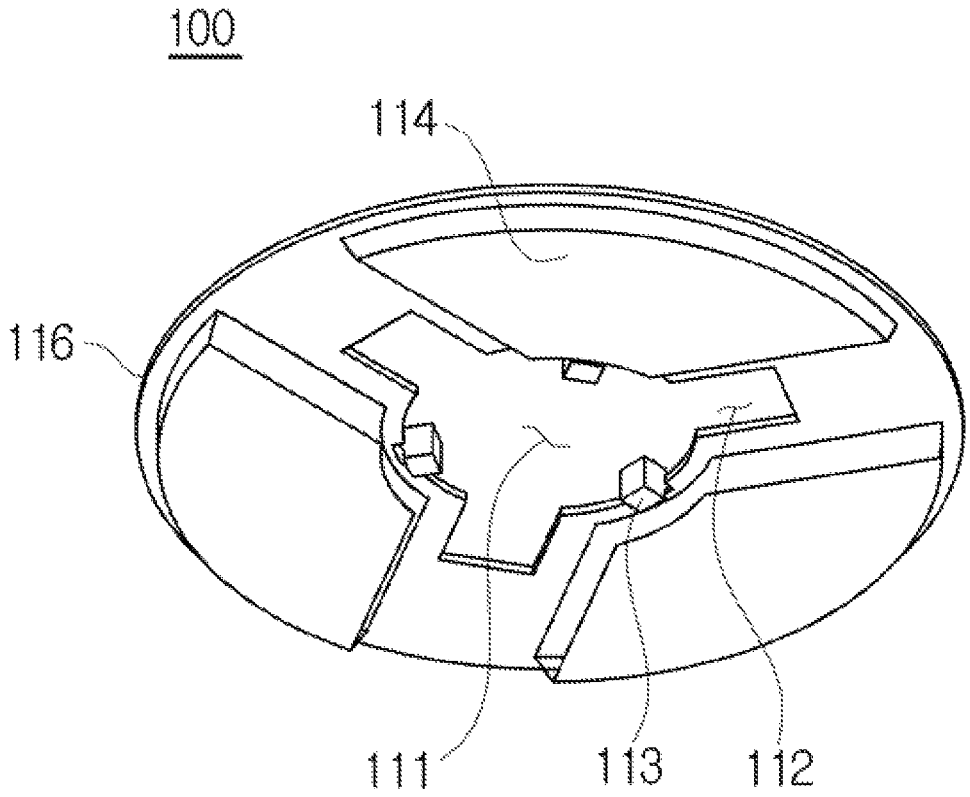
FIG. 5 is a drawing illustrating an oil plate of the compressor in accordance with an embodiment.

FIG. 5 is a drawing illustrating the oil stabilizing member 100 of the compressor 1 in accordance with an embodiment.

The oil stabilizing member 100 may be provided in the shape of a planar plate 116 as to cover the surface of the oil formed by gravity of the oil storage space 100. The oil may be stored at a lower portion of an inside the closed container 10, and form a surface having a shape corresponding to a cross section of the closed container 10. Thus, the oil stabilizing member 100 is provided in the shape of a planar plate 116 having a circular form that corresponds to the cross section of the closed container 10, and may cover the surface of the oil to prevent the oil from scattering.

As for the oil which drops downward by gravity after being delivered to the driving unit 20 and the compression unit 30 through the rotating shaft 21 to be introduced again into the oil storage space 110, the oil stabilizing member 100 may be formed in a way to be spaced apart in a predetermined distance from an inner surface of the closed container 10. That is, different from the coupling part 166 of the lower flange 16 that is fixed by use of a screw while making contact with an inner surface of the closed container 10, the outer circumferential surface of the oil stabilizing member 100 is installed in a way not to make contact with the inner surface of the closed container 10.

The oil stabilizing member 100 is provided in a way to float on the surface of oil according to the flow of the oil. For the above, the oil stabilizing member 100, as to receive a lift to float on the surface of the oil, may include at least one concavo-convex structure 114 formed at a surface thereof that makes contact with the surface of the oil. The concavo-convex structure 114 formed in a convex manner downward may include an inside space into which gas may be injected. By injecting light gas, such as nitrogen, into the inside space, the oil stabilizing member 100 is effectively floated on the surface of oil.

In addition, the oil stabilizing member 100 may be formed of material that is lighter than oil. That is, by forming the oil stabilizing member 100 by use of material such as plastic having a smaller specific gravity than oil, the oil stabilizing member 100 may be moved along the flow of the oil while floating on the surface of the oil.

Figure 6:
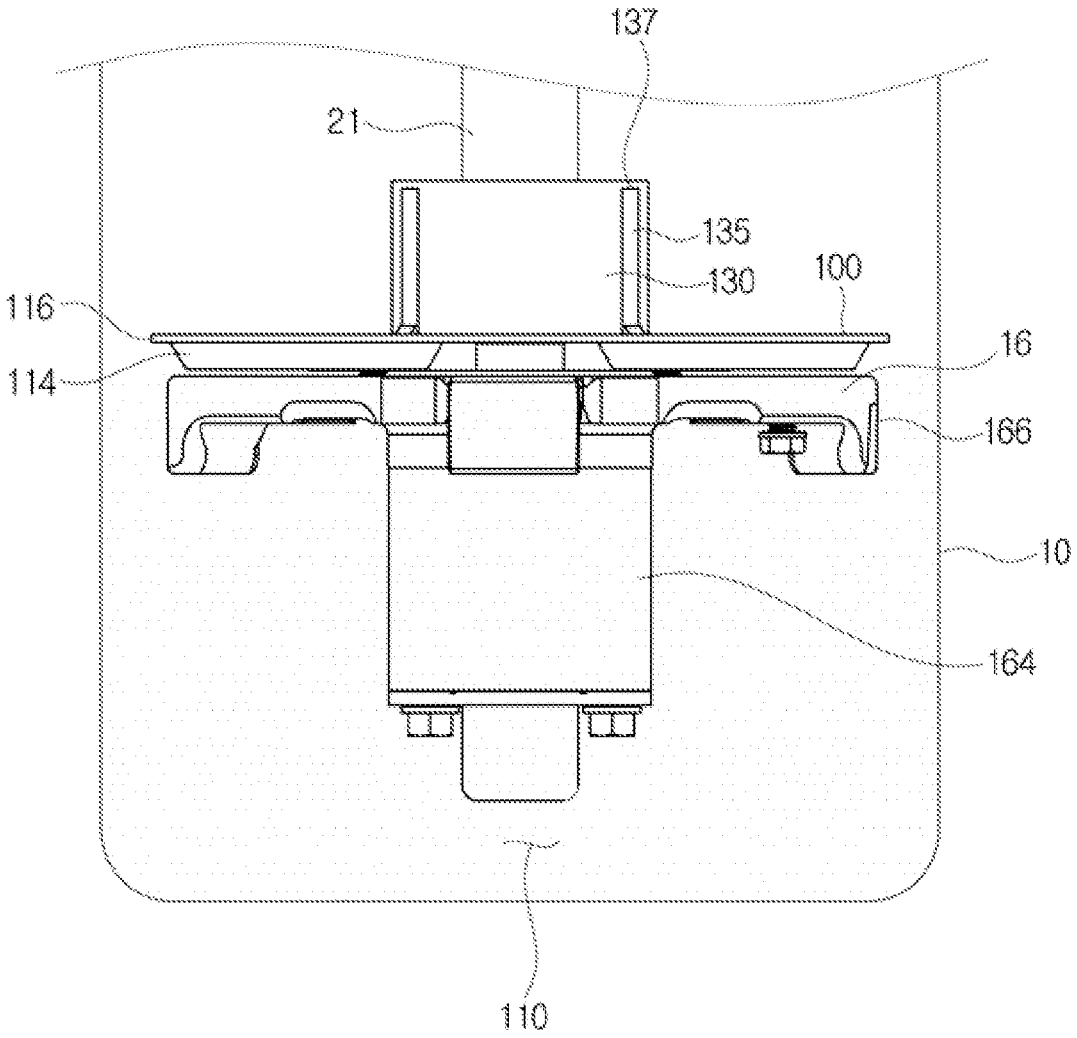
FIGS. 6 and 7 are drawings illustrating an operation of an oil stabilizing member of the compressor in accordance with an embodiment.
Figure 7:
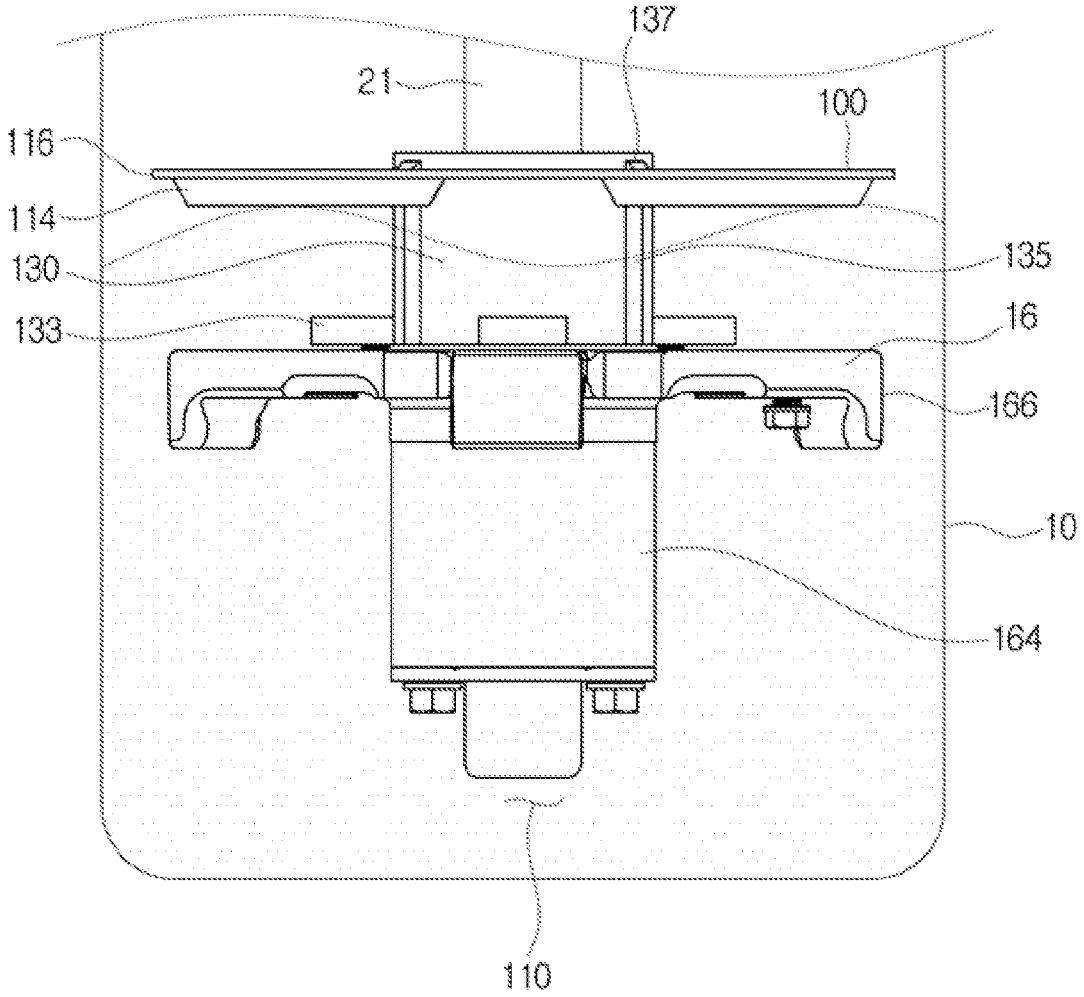

FIG. 6 and FIG. 7 are drawings illustrating an operation of the oil stabilizing member 100 of the compressor 1 in accordance with an embodiment.

The oil stabilizing member 100 may be positioned in a way to make contact with the surface of oil while moving along the flow of the oil. FIG. 6 is a drawing illustrating a case when the oil stabilizing member 100 is located at the lowest end, and FIG. 7 is a drawing illustrating a case when the oil stabilizing member 100 is located at the highest end.

According to a driving of the compressor 1, the surface of oil may form the shape of a wave without forming a plane surface by gravity. In response to the rise of the surface of the oil forming a wave, the oil stabilizing member 100 may prevent the oil from being scattered while moving up and down. As illustrated on FIG. 6 and FIG. 7, the oil stabilizing member 100 is moved up and down along the moving groove 135. Thus, even in a case when the oil is not stabilized while forming a large wave, the oil stabilizing member 100 may be located at the surface of the oil, to prevent the scattering of the oil.

As is apparent from the above, oil can be prevented from being scattered upward due to a driving of a compressor, by use of an oil stabilizing member floating on the surface of the oil.

The oil stabilizing member may move along the flow of oil while moving up and down by being guided by a guide inserted around a rotating shaft.

Although a few embodiments have been shown and described with respect to a scroll compressor, it would be appreciated by those skilled in the art that applications to all kinds of compressors having an oil storage space may be made without departing from the principles and spirit of the disclosure, the scope of which is defined in the claims and their equivalents.

What is claimed is:

1. A compressor, comprising:

a fixed scroll fixed at an inside of a closed container;

an orbiting scroll configured to compress refrigerant while revolving relative to the fixed scroll;

a rotating shaft to deliver a rotating force to the orbiting scroll;

a guide inserted around the rotating shaft and comprising at least one vertically extending groove; and an oil stabilizing member which includes at least one protrusion that is inserted into the at least one vertically extending groove which enables the oil stabilizing member to move vertically along the at least one groove to prevent oil stored at a lower portion of the inside of the closed container from being scattered.

2. A compressor, comprising:

a fixed scroll fixed at an inside of a closed container;

an orbiting scroll configured to compress refrigerant while revolving relative to the fixed scroll;

a rotating shaft to deliver a rotating force to the orbiting scroll;

upper and lower flanges fixed to upper and lower end portions of an inner side of the closed container to rotatably support the rotating shaft;

an oil stabilizing member movably installed at an upper portion of the lower flange to prevent oil stored at a lower portion of the inside of the closed container from being scattered; and a guide inserted around the rotating shaft to be coupled to the lower flange, wherein the guide is positioned between the oil stabilizing member and the rotating shaft.

3. The compressor of claim 2, wherein:

the oil stabilizing member moves up and down along the rotating shaft according to flow of the oil.

4. The compressor of claim 2, wherein:

the guide is coupled to the lower flange by use of at least one screw, and is provided at a lower portion thereof with at least one screw coupling part to which the at least one screw is coupled.

5. The compressor of claim 4, wherein:

the guide comprises at least one groove vertically extending, and the oil stabilizing member comprises at least one protrusion that is inserted into the at least one groove to move vertically along the at least one groove.

6. The compressor of claim 5, wherein:

the guide comprises a fixing step positioned at an upper portion of the at least one groove to fix an upward movement of the at least one protrusion to prevent the oil stabilizing member from being separated from the guide.

7. The compressor of claim 6, wherein:

the oil stabilizing member comprises at least one penetrating groove that corresponds to the at least one screw coupling part, so that the at least one protrusion is insertedly coupled to the at least one groove at a lower portion of the guide.

8. A compressor comprising:

a closed container provided with an inlet port and an outlet port;

a compression unit configured to compress refrigerant introduced into an inside of the closed container through the inlet port;

a driving unit configured to provide a driving force to drive the compression unit;

a rotating shaft configured to deliver the driving force to the compression unit;

an oil storage space formed at a lower portion of the inside of the closed container and configured to store a predetermined oil while in contact with one end portion of the rotating shaft;

an oil stabilizing member installed so as to move along a surface of oil formed at the oil storage space, thereby preventing the oil from being scattered and thus released through the outlet port, and the oil stabilizing member having a coupler allowing the rotating shaft to be inserted thereinto after passing therethrough, wherein the oil stabilizing member is moved along the rotating shaft in response to flow of the oil;

a guide configured to guide the movement of the oil stabilizing member and positioned between the coupler and the rotating shaft; and a lower flange coupled to a lower portion of an inner side of the closed container to rotatably support a lower portion of the rotating shaft with respect to the closed container, wherein the guide is inserted around the rotating shaft and fixedly coupled to the lower flange.

9. The compressor of claim 8, wherein:

the guide comprises at least one moving groove, and the oil stabilizing member comprises at least one moving protrusion protruding from the coupler toward the guide, so that the at least one moving protrusion is inserted into the at least one moving groove, thereby coupling the oil stabilizing member to the guide.

10. The compressor of claim 9, wherein:

the at least one moving groove is formed in a longitudinal direction, and the oil stabilizing member is moved in a longitudinal direction along the at least one moving groove.

11. The compressor of claim 10, wherein:

the guide comprises a fixing step positioned at an upper portion of the at least one moving groove to fix an upward movement of the at least one moving protrusion moving along the at least one moving groove.

12. The compressor of claim 8, wherein:

the guide comprises at least one screw coupling part to be coupled to the lower flange, and the at least one screw coupling part circumferentially protrudes at a lower portion of the guide.

13. The compressor of claim 12, wherein:

the oil stabilizing member comprises at least one penetrating groove that is formed at the coupler while having a shape corresponding to the at least one screw coupling part, so that the oil stabilizing member is coupled to the guide after passing through the at least one screw coupling part.

* * * * *